United States Patent [19]

Trott et al.

[11] 4,150,755

[45] Apr. 24, 1979

[54] PANEL PLACING DEVICE

[76] Inventors: Lowell C. Trott, P.O. Box 625, Trinidad, Calif. 95570; Albert E. Hall, 8885 Halvorson Dr., Elk Grove, Calif. 95624

[21] Appl. No.: 870,609

[22] Filed: Jan. 19, 1978

[51] Int. Cl.[2] ..... B66F 11/00

[52] U.S. Cl. ..... 414/11; 254/3 C; 254/4 C

[58] Field of Search ..... 214/1 SW, 1 BD, 1 D, 214/1 H, 130 R, 777; 254/3 R, 3 B, 3 C, 2 C, 4 R, 4 B, 4 C

[56] References Cited

U.S. PATENT DOCUMENTS

| | | | |
|---|---|---|---|
| 2,465,206 | 3/1949 | Davis | 214/1 SW |
| 2,719,060 | 9/1955 | Taylor | 214/1 SW |
| 2,815,132 | 12/1957 | Stone | 214/1 SW |
| 3,487,952 | 1/1970 | Owens et al. | 214/1 SW |
| 3,822,023 | 7/1974 | Cordel | 214/1 SW |

*Primary Examiner*—L. J. Paperner

*Attorney, Agent, or Firm*—Lothrop & West

[57] ABSTRACT

A panel placing device has a carriage frame on which are pivoted links connected pivotally to a panel frame adapted to support a panel. There are springs connected to the links and to the panel frame for urging the panel frame in one rotational direction. A lever pivoted on the carriage frame has a one way abutment with the panel frame and is moved by a tackle connected to the lever and to a rotary drum on the carriage frame. The lever is also pivoted on the carriage frame to swing aside. The drum is rotatable by a crank and is under control of a one way brake and a one way clutch.

8 Claims, 5 Drawing Figures

PANEL PLACING DEVICE

BACKGROUND OF THE INVENTION

Various devices have been proposed for lifting or placing sheets of wall board or comparable panels. Representative are thin plywood sheets, particle board, wall board and similar building materials. The devices are effective to lift, position and hold the sheets against the receiving abutment while the sheets are being permanently fastened. A typical apparatus of this type is disclosed in U.S. Pat. No. 2,465,206 which discloses a vertical standard supported by a frame. A rack is slidably received in the standard and supports at its upper end a generally rectangular sheet holder or panel holder. A pinion meshes with the rack and is rotated by a crank to elevate the rack and urge the sheet holder toward the ceiling with a sheet of wall board borne on the sheet holder. In upper position the wall board is disposed against the ceiling so that the wall board can be nailed or otherwise fastened in place.

There is some disadvantage in that some of the mechanism is relatively large and bulky in order to handle panels or sheets appropriately and the device is somewhat expensive to manufacture.

U.S. Pat. No. 3,487,952 discloses a duty unit which is suitable for installing heavy sheet rock or like material on ceilings. However, the apparatus is quite complicated in construction and is costly as well as bulky. This means that small sheet rock installation firms and the like are not in a position to utilize the apparatus and the equipment rental companies likewise are precluded by high capital costs from freely utilizing the structure.

SUMMARY OF THE INVENTION

The present device is an improved panel placing device. Some of the prior structures have stability problems which are overcome in the present instance by providing a panel placing device with various arm and lever constructions effective to permit an operator to move the supporting mechanism from a loading or rest position into a placing position either laterally or vertically. A panel is pressed evenly against an abutment such as a vertical wall or a horizontal ceiling, even despite some misalignment. The present apparatus is simple in construction and performs its intended functions in a reliable, safe and stable manner.

An object of the present invention is to provide a panel placing device effective quickly to elevate or position and firmly press a panel of light or heavy material against a generally planar receiving surface, such as a wall or ceiling, and is stable and effective to maintain the desired position.

It is another object of the present invention to provide a panel placing device that is simple in construction and inexpensive to manufacture and use.

It is another object of the invention to provide a panel placing device that is lightweight, readily portable and permits installation of a panel on a ceiling or wall by a single workman.

It is another object of the present invention to provide a generally improved panel placing device especially useful with sheet rock.

Other objects, together with the foregoing, are attained in the embodiment of the invention described in the following description and illustrated in the accompanying drawings.

DESCRIPTION OF THE PREFERRED EMBODIMENT

Figure 1:
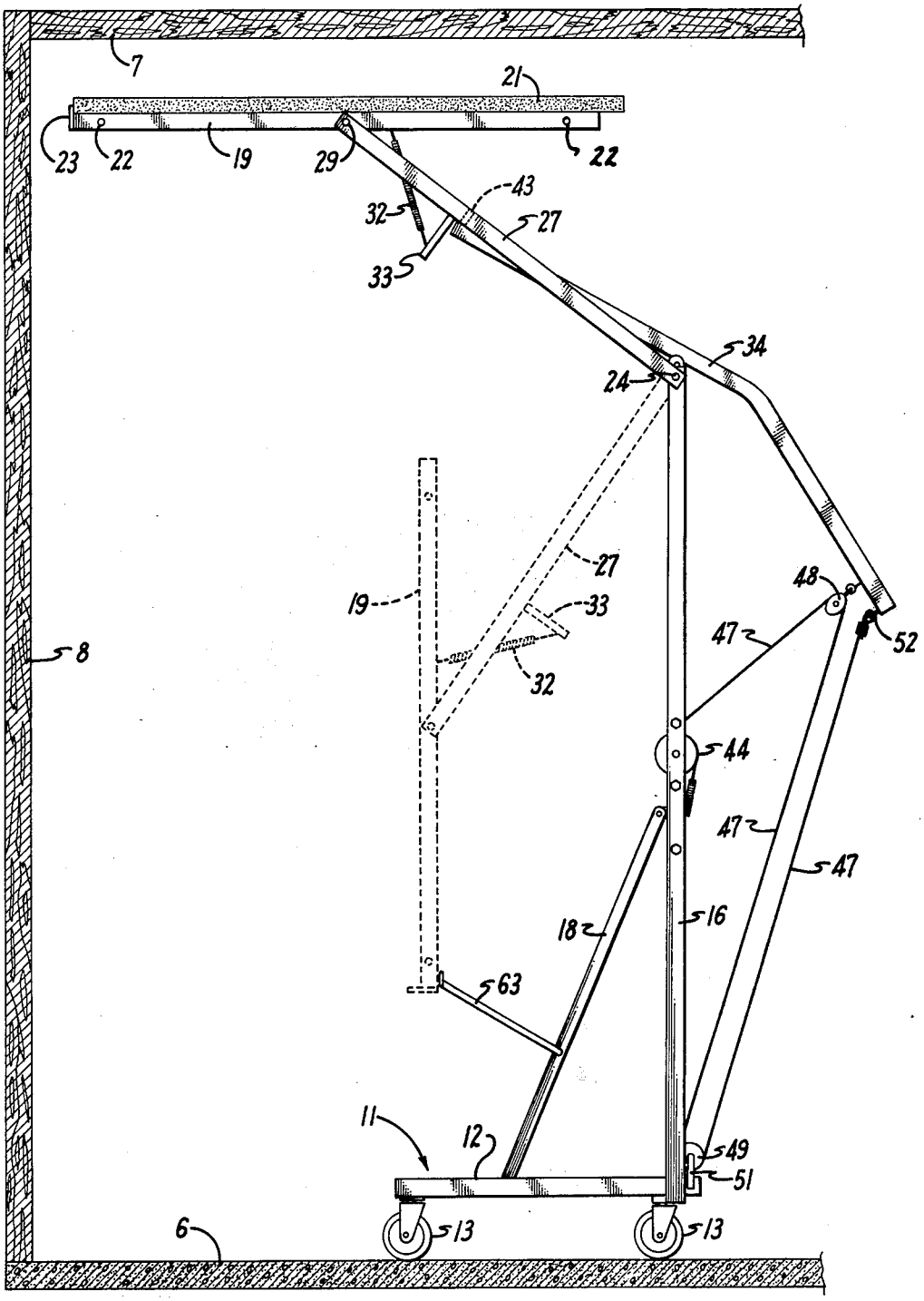
FIG. 1 is a side elevation of a panel placing device, some parts being shown in full lines and adjacent a ceiling and being shown in broken lines and adjacent an upright wall.
Figure 2:
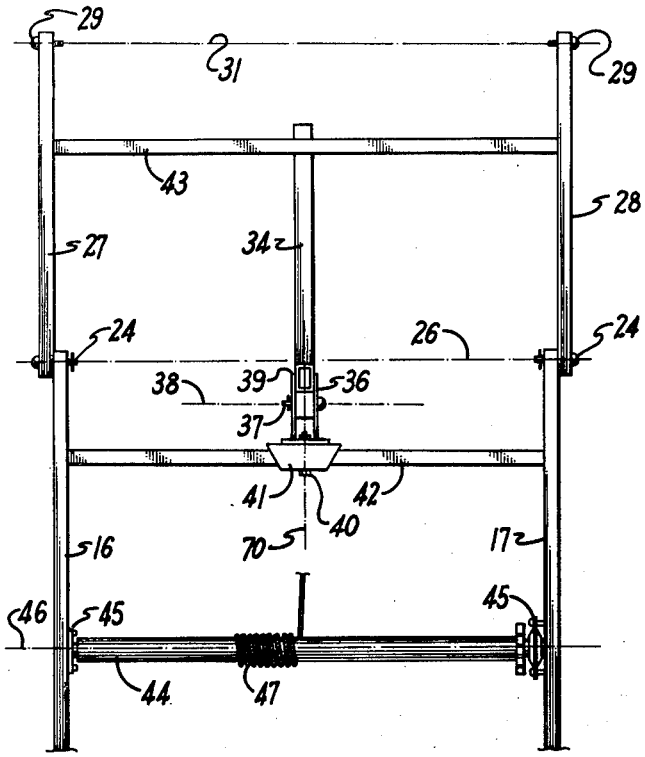
FIG. 2 is an end elevation of a portion of the device of FIG. 1.
Figure 3:
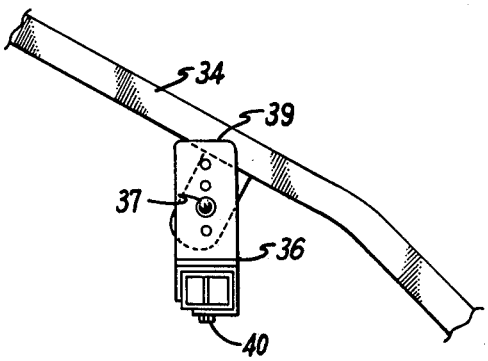
FIG. 3 is an enlarged detail of a lever mounting structure.

While the panel placing device of the present invention is susceptible to embodiment in numerous different ways the structure as shown and described herein has been made, tested and satisfactorily used.

In one instance, the panel placing device is employed on a floor 6 spaced as is customary from a regular ceiling 7 and related as is customary to an adjacent, vertical wall 8. The floor, ceiling and wall are at least approximately in the regular, right angle relationship to each other. Adapted to roll on the floor is a carriage 11 having a framework 12 constructed of the customary structural shapes and supported on wheels 13 designed freely to roll on the floor 6. The wheels are preferably caster wheels so that the carriage 11 can be moved about in any desired direction into an intended position. If desired, the caster wheels can be provided with standard friction brakes (not shown) to hold the carriage 11 in any set position.

Forming part of the carriage frame are uprights 16 and 17 extending vertically substantially at right angles to the floor 6 and held in position by braces 18. Designed to be related to the carriage frame 12, as will appear, is a panel frame 19 comprised of a number of structural shapes and having a generally rectangular configuration, being appropriately fastened together and braced. The frame 19 has a size approximating the size of panel 21 of a standard nature such as a sheet of wall board or sheet rock or the like having known dimensions and also having a standard thickness. The panel 21 readily rests upon and can extend over the margins of the panel frame 19. If desired, there may be augmenting extension rods 22 positioned appropriately to afford support to overhanging portions of the panel 21. One of the edges, preferably a longitudinal edge of the panel 19, is augmented by a ledge 23 upstanding from the panel frame a distance somewhat less than the thickness of the panel 21 itself. The ledge serves as a support for the panel when the panel frame is tilted away from a generally horizontal position. The ledge does not project far enough to preclude firm surface contact of the panel 21 with an intended abutment.

Adjacent their upper ends, the uprights 16 and 17 serve as mountings for pivot pins 24 disposed on a generally transverse, horizontal, first axis 26 and serving as pivots for one end of a pair of side links 27 and 28. These are arranged generally parallel to each other and at their opposite, otherwise free ends are joined by pivot pins 29 to the panel frame 19. The pins 29 are disposed on a second axis 31 parallel to the first axis 26. In this way the panel frame 19 is related to the carriage frame and is generally free for relative movement between various orientations.

To impose some resilient restraint on the relative operation or motion of the panel frame 19 and the links 27 and 28, a pair of springs 32 connect at one end to the panel frame 19 and at the other end to brackets 33 outstanding from each of the links. The panel frame 19 is thus urged to rotate clockwise, as seen in FIG. 1, relative to the links. The springs 32, however, are of such tension and length as to permit the panel frame to be substantially relaxed when it is in a position substantially parallel to the ceiling 7 or in another orientation when the panel frame 19 is substantially parallel to the wall 8.

In order that the links 27 and 28 and the attached mechanism may be appropriately maneuvered, an operating lever 34 is supported on the carriage frame uprights 16 and 17. Adjacent its central portion the lever 34 is mounted in a U-shaped supporting bracket 36 by means of a cross pin 37. The axis of the cross pin constitutes a third axis 38 parallel to the axes 26 and 31 or approximately so. It is beneficial to have the first axis 26 and the third axis 38 substantially or actually coincident although some displacement between them is acceptable. The bracket 36 has side ears 39 serving as guides for rotational or rocking movement of the lever 34 about the cross pin 37.

So that the lever 34 can pivot in at least two planes, the bracket 36 is supported on a vertically extending pin 40 secured in a clip 41 straddling and secured to a cross bar 42 forming part of the carriage frame 12 and extending between the uprights 16 and 17.

The lever 34 is so proportioned that one end is freely engageable in one direction only with a cross member 43 spanning the space between and secured to the links 27 and 28. Preferably, the free end of the lever is not firmly fixed to the cross member 43 but is merely in abutment therewith. While a lifting force can readily be transmitted from the lever 34 to the cross member 43 and so to the panel frame 19, the lever can easily be withdrawn from contact with the cross member and can move away therefrom.

To move the lever toward and away from its one way abutment with the cross member fixed to the links connected to the panel frame, there is provided an appropriate operating structure. The structure shown is representative of any one of several different kinds of moving mechanisms that can be utilized and has served admirably in the present instance.

Figure 4:
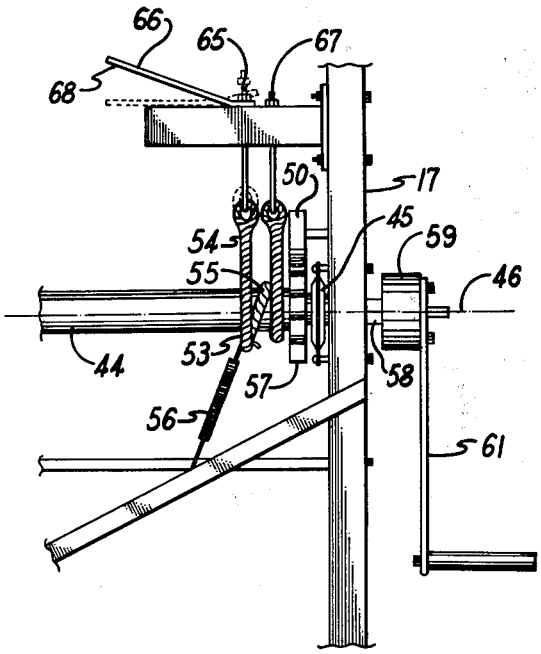
FIG. 4 is an enlarged detail of a crank and control structure.

Journaled in the uprights 16 and 17, particularly as shown in FIG. 4, is a cross drum 44 appropriately supported by journal bearings 45 in the uprights for free rotation about a cross axis 46 parallel to the first, second and third axes. Fastened to and wound around the drum 44 is a line 47 such as an ordinary rope of a pliant nature. The line extends tangentially from the drum to a pulley 48 mounted in the customary fashion on the other or operating end of the lever 34. From the pulley 48 the line 47 extends to a lower pulley 49 secured to a cross bar clip 51 at the lower end of the frame 12. After extending around the pulley 49 the line proceeds to an anchor 52 at the extreme end of the lever 34.

When the drum 44 is rotated in one direction the line 47 is taken in by winding about the drum and so pulls on and operates the lever about the third axis 38 in a clockwise direction, as seen in FIG. 1. When the line 47 is paid out from the drum 44 the lever 34 tends to move by gravity in a generally counterclockwise direction approximately between the solid line position shown in FIG. 1 with the panel 19 adjacent the ceiling 7 and the dotted line position shown in FIG. 1 with the panel frame 19 disposed substantially vertically and parallel to the wall 8.

Various control devices are afforded to make sure that the motion of the parts is as desired and that the device is not permitted to depart from the operator's imposed force, for safety and control reasons.

As particularly indicated in FIG. 4 one of the control devices is a oneway rope brake 53. This is simply a line 54 at one end movably connected to the frame through a vertically translatable adjuster bolt 65 selectively liftable by the small angled portion of a bent lever 66 and at the other end firmly secured to the frame through an eye-bolt 67. The fixed end of the line extends around the bottom and rear of the drum 44, thence forwardly over the drum in a turn 55. The bottom of the turn 55 reverses direction to form a lower eye through which extends the upper end of a tension spring 56, the reversed line then extending directly upwardly from the lower eye to connect to the movable bolt 65. Since the line 54 is wound about the drum 44 in one tightening direction only the brake is effective primarily in one way, namely, the brake permits clockwise (in FIG. 1) rotation of the link and lever structure 34 into uppermost position but tends to prevent lowering of the panel 19 especially when loaded. To release the brake 53 after the panel 19 is installed, the inclined handle 68 of the bent lever is manually depressed, thereby elevating the small angled end of the lever and the adjuster bolt 65 against the force of the coil spring 56 thus relieving the tension on the turn 55 and the fixed end of the line and allowing the drum 44 to rotate in a clockwise direction (in FIG. 1) so that the link and lever structure, as well as the panel frame 19, can rotate in a counterclockwise direction, as appears in FIG. 1, and move from elevated position to lowered position.

In addition, there is a lock 50 effective in any location of the parts to serve as a positive hold. This is a pawl and ratchet structure that can be manipulated by the operator. The pawl can be lifted from the ratchet 57 and permit free motion as governed by the brake 53 or the pawl can be permitted to rest by gravity against the ratchet 57 so as to hold the parts against one way rotation despite virtually any imposed force.

Figure 5:
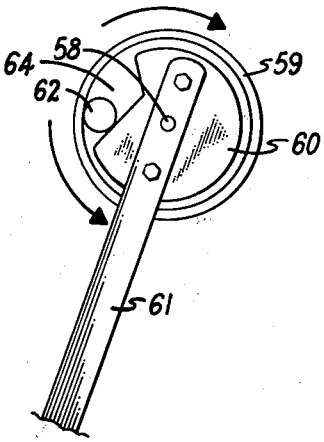
FIG. 5 is an enlarged detail of part of a clutch elevation in elevation.

Pursuant to the invention rotation is given to the drum 44 in any selected fashion by power or manually. In most instances, and for light operation, rotation is afforded manually. For that reason, as particularly shown in FIG. 5, an axle 58 unitary with the drum 44 extends into and is unitary with a cup 59 surrounding a concentric cam 60 loose on the shaft 58 and to which an operating lever 61 or crank is fastened. The cam 60 has a recess 64 forming an irregular contour in order to afford a jamming and releasing interengagement with a jamming roller 62 effective to impart one way or clockwise rotation as seen in FIG. 5 from the crank 61 to the cup 59 and shaft 58 and so to the drum 44. Should the drum 44 tend to over-run the hand crank 61 the jamming roller 62 is rolled by the cup rim in a clockwise direction into the recess 64 and is freed from frictional engagement with the cup rim, thereby preventing backlash upon the operator.

In a typical mode of operation of the device, the parts are initially positioned substantially in the broken line position in FIG. 1 with the ledge 23 at the bottom and the panel frame 19 extending approximately vertically or perhaps inclined slightly from the vertical resting, if desired, against stops 63 on the framework 12. A workman places a representative panel 21 on the ledge 23 and leans the panel against the panel frame. He then rotates the crank 61 in an appropriate direction to wind the line 47 onto the drum 44. The line being shortened then rotates the operating lever 34 in a generally clockwise direction (FIG. 1) about the third axis 38 and causes the end of the lever to abut the cross member 43. The member 43 responds and simultaneously rotates the two links 27 and 28 with the lever in a generally clockwise direction toward the ceiling about the first axis 26.

At an appropriate point, one portion, at least, of the panel 21 contacts a portion of the ceiling 7. If the ceiling is not quite horizontal or if the panel is not quite level that is immaterial since the continued upward movement of the links 27 and 28 causes further, somewhat rotary movement of the panel toward the ceiling about the second axis 31 until such time as the panel is pressed uniformly against the ceiling in an appropriate fashion. In many instances the final adjusting or seating movement is accompanied by extension of the springs 32. The springs are thus effective to permit complete contact of the panel against the abutment whether or not there is exact alignment with other portions of the structure. During the lifting movement the ledge 23 is effective to preclude downward displacement of the panel.

With the panel 21 in position against the ceiling, permanent fastenings are placed. The mechanism is thereafter restored to its original position by release of any withholding force of the pawl and ratchet holder 50 and from the rope brake 53.

By the same token, if the panel 21 starts from the broken line position in FIG. 1 in approximately a vertical attitude and if the carriage 11 is in proper relationship to a vertical wall 8, the panel 21 can be moved, still in its approximately vertical attitude against the wall 8 and can be pressed thereagainst by appropriate rotation of the crank 61. The springs 32 may again yield to make sure that the panel is tightly and uniformly pressed against the abutment or wall. Permanent fastenings are then imposed and the mechanism is backed off.

When the carriage 11 is to be moved from its location to a different location, perhaps through a doorway of standard width, the panel frame 19 is put down to its generally vertical position. In order to reduce the projection of the operating lever 34, the free end of the lever is removed or pulled away from its abutment with the cross member 43 between the links 27 and 28 and is rotated about the upright axis 70 extending through the vertical pivot pin 40 so that the lever and any attached tackle is moved through approximately 90° so as to lie in the general plane of the uprights 16 and 17. In that location the overall compass or width of the assembly is substantially less than the customary door opening so that the carriage 11 can be wheeled through for reuse in the new place.

What is claimed is:

1. A device for use in placing a panel against an abutment comprising a carriage frame including a pair of uprights, a pair of links, means for pivoting said links on said uprights for rotation about a first axis, a panel frame, means for pivoting said panel frame on said links for rotation about a second axis, means interconnecting said links and said carriage frame for rotating said links relative to said carriage frame, said interconnecting means including a lever, and means for mounting said lever on said carriage frame for rotation about a third axis parallel to said first axis and said second axis to move into engagement with and to rotate said links.

2. A device as in claim 1 in which said engagement is one-way.

3. A device as in claim 1 in which said interconnecting means includes a winch drum rotatably mounted on said carriage frame, and tackle engaging said drum and one end of said lever.

4. A device as in claim 1 in which said third axis is substantially coincident with said first axis.

5. A device as in claim 3 including a one-way rotational control for said drum.

6. A device as in claim 3 in which said control is a brake.

7. A device as in claim 3 in which said control is a clutch.

8. A device as in claim 1 in which said panel frame is planar and rectangular and including a ledge along one edge of said panel frame and extending beyond the plane of said panel frame.

* * * * *